US006263813B1

(12) United States Patent
Toume et al.

(10) Patent No.: US 6,263,813 B1
(45) Date of Patent: Jul. 24, 2001

(54) APPARATUS FOR PREVENTING STITCHING FROM RAVELING

(75) Inventors: Fumio Toume; Kazuyuki Nakano; Masashi Watanabe, all of Osaka (JP)

(73) Assignee: Pegasus Sewing Machines Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/546,330

(22) Filed: Apr. 10, 2000

(30) Foreign Application Priority Data

May 6, 1999 (JP) ..... 11-125904

(51) Int. Cl.[7] ..... D05B 65/00
(52) U.S. Cl. ..... 112/291
(58) Field of Search ..... 112/291, 165, 112/475.17, 163, 197, 199

(56) References Cited

U.S. PATENT DOCUMENTS

| | | | | |
|---|---|---|---|---|
| 1,284,911 | * | 11/1918 | Lautenschlager | 112/291 |
| 4,169,422 | * | 10/1979 | Hayes et al. | 112/291 |
| 5,722,338 | * | 3/1998 | Douyasu | 112/291 X |
| 5,881,663 | * | 3/1999 | Tsukioka et al. | 112/475.17 |
| 6,119,613 | * | 9/2000 | Douyasu et al. | 112/475.17 |

* cited by examiner

*Primary Examiner*—Ismael Izaguirre
(74) *Attorney, Agent, or Firm*—Jones, Tullar & Cooper, P.C.

(57) ABSTRACT

The present invention relates to an apparatus for preventing a double chain stitching from raveling. Looper thread engaging structure engages with the looper thread consecutive to the looper from the cloth by moving when the looper is at the forward position and forms a looper thread loop consecutive from the cloth at the engaged portion by driving a sewing machine in the engaged state. A looper thread cutter cuts the looper thread loop at the engaged portion and a thread cutter cuts the loop-shaped needle thread consecutive to the needle via the looper from the cloth and the looper thread consecutive to the looper from the cloth between the cloth and the looper. Therefore, it is able to prevent a double chain stitching from raveling from the stitching end side. Further, defining structure is provided to define the moving distance of the looper thread engaging structure. The length of the looper thread loop is changed by definition of the moving distance of the looper thread engaging structure by the defining structure. Therefore, the thread of the thread end left over in the cloth by the looper thread cutter can be varied. By varying the length of the thread end consecutive to the sewn end side, a good-looking sewn product is obtained.

9 Claims, 6 Drawing Sheets

APPARATUS FOR PREVENTING STITCHING FROM RAVELING

BACKGROUND OF THE INVENTION

1. Field of the Invention

The present invention relates to an apparatus for preventing a stitching from raveling from the sewn end side on forming a double chain stitch in a cloth by a sewing machine.

2. Description of the Prior Art

This kind of stitching ravel preventing device is used in a sewing machine having at least one needle moving vertically, and a looper oscillating almost horizontally between the forward position and backward position across the needle, in which the double chain stitch is formed in the cloth after a thread triangle is formed by a loop-shaped needle thread consecutive to the needle via the looper from the cloth and a looper thread along the looper via the looper eyelet from the cloth by collaboration of the needle and looper.

By this sewing machine, when a stitch, for example, JISL0120 stitch type 406, is formed, if the looper thread is pulled from the sewn end side of the stitching, the stitching is raveled out. As an apparatus for preventing a stitching from raveling, it is disclosed in Japanese Laid-open Patent No. 9-225163 that the construction comprises such a sewing machine, looper thread engaging means, a looper thread cutter and a thread cutter.

A looper thread engaging means forms a looper thread loop consecutively from the cloth at the engaged portion by driving the sewing machine in a state engaged within the longer thread consecutive to the looper from the cloth by moving when the looper is located at the forward position. The looper thread cutter cuts off the looper thread loop at the engaged portion. The thread cutter cuts off the loop-shaped needle thread consecutive to the needle via the looper from the cloth and the looper thread consecutive to the looper from the cloth between the cloth and the looper According to such a construction, when nearing the finish of sewing on the double chain stitch formed in the cloth, it makes the looper thread engaging means engage with the looper thread consecutive to the looper from the cloth. In this state, the sewing machine is driven for one stitch, and the looper thread loop consecutive from the cloth is formed at the engaged portion, and then the looper thread loop at the engaged portion is cut off, and afterward, or at the same time, the loop-shaped needle thread consecutive to the needle through the looper from the cloth and the looper thread consecutive to the looper from the cloth are cut off between the cloth and the looper.

In such a conventional ravel preventing method, however, since the moving distance of the looper thread engaging means cannot be defined, the length of the looper thread loop formed by the looper thread engaging means cannot be changed, and therefore the length of the thread end left over in the cloth by the looper thread cutter could not be changed.

SUMMARY OF THE INVENTION

The present invention is provided in light of the above-mentioned background, and it is hence an object of the present invention to provide an apparatus capable of preventing a stitching from raveling from the sewn end side on forming a double chain stitch in a cloth by a sewing machine, and obtaining a good-looking sewn product by varying the length of thread end consecutive to the sewn end side.

To achieve the object, the apparatus for preventing a stitching from raveling of the present invention comprises a sewing machine having at least one needle (5, 6) moving vertically and a looper (3) for forming a double chain stitch (S) made up of needle threads (8, 9) and looper thread (10) in a cloth (W) by collaboration with the needle by oscillating almost horizontally between the forward position and backward position across the needle (5, 6), looper thread engaging means (11) for forming a looper thread loop (10L) consecutive from the cloth (W) at its engaged portion by driving the sewing machine in an engaged state by engaging with the looper thread (10) consecutive to the looper (3) from the cloth (W) by moving when the looper (3) is at the forward position, a looper thread cutter (12) for cutting the looper thread loop (10L) at the engaged portion, and a thread cutter (30) for cutting loop-shaped needle threads (8L, 9L) consecutive to the needles (5, 6) via the looper (3) from the cloth (W) and the looper thread (10) consecutive to the looper (3) from the cloth (W) between the cloth (W) and the looper (3), in which defining means (27) is further provided to define the moving distance of the looper thread engaging means (11), and the length of the looper thread loop (10L) is changed by definition of moving distance of the looper thread engaging means (11) by the defining means (27), and therefore the length of the thread end left over in the cloth (W) by the looper thread cutter (12) can be varied.

According to the present invention having the above-mentioned characteristic construction, when the looper is at the forward position near the sewing finish on the double chain stitch formed in the cloth by the sewing machine, the looper thread engaging means is moved and is engaged with the looper thread consecutive to the looper from the cloth. The moving distance of the looper thread engaging means is defined by the defining means. In this engaged state, by driving the sewing machine, a looper thread loop consecutive from the cloth is formed at the engaged portion of the looper thread engaging means. The length of the looper thread loop is defined by changing the engaged state with the looper thread engaging means by the defining means. The looper thread loop at the engaged portion by the looper thread engaging means is cut off by the looper In the apparatus having such a construction, the looper thread engaging means includes at least a looper thread engaging member and a driving member for moving the looper thread engaging member to the engagement position of the looper thread, and the defining means is composed of a stopper piece for defining the moving distance of the driving member. When the looper thread engaging member is moved by the driving member and is engaged with the looper thread consecutive to the looper from the cloth, its moving distance is defined by the stopper piece.

Also, in the apparatus having such a construction, the looper thread engaging member has a taper portion and two crooks protruding nearly at the middle position and tip position of the taper portion. When a position of the looper thread engagement with the taper portion across the crook at the middle position can be changed depending on the definition of the moving distance of the driving member by the stopper piece, the crook can be easily engaged with the looper thread consecutive to the looper from the cloth. In addition, the looper thread loop can be cut off by the looper thread cutter securely at the corresponding crook.

Moreover, the stopper piece is a rectangular block fixed in the sewing machine so as to be variable in angle and the definition of the moving distance in the driving member is done by varying the fixing angle of the rectangular block in the sewing machine, the moving distance of the driving member can be defined in a simple construction.

Other objects and effects of the present invention will be better understood from the following detailed description of the embodiments.

PREFERRED EMBODIMENTS OF THE INVENTION

A preferred embodiment of the present invention is described below while referring to the accompanying drawings.

Figure 1:
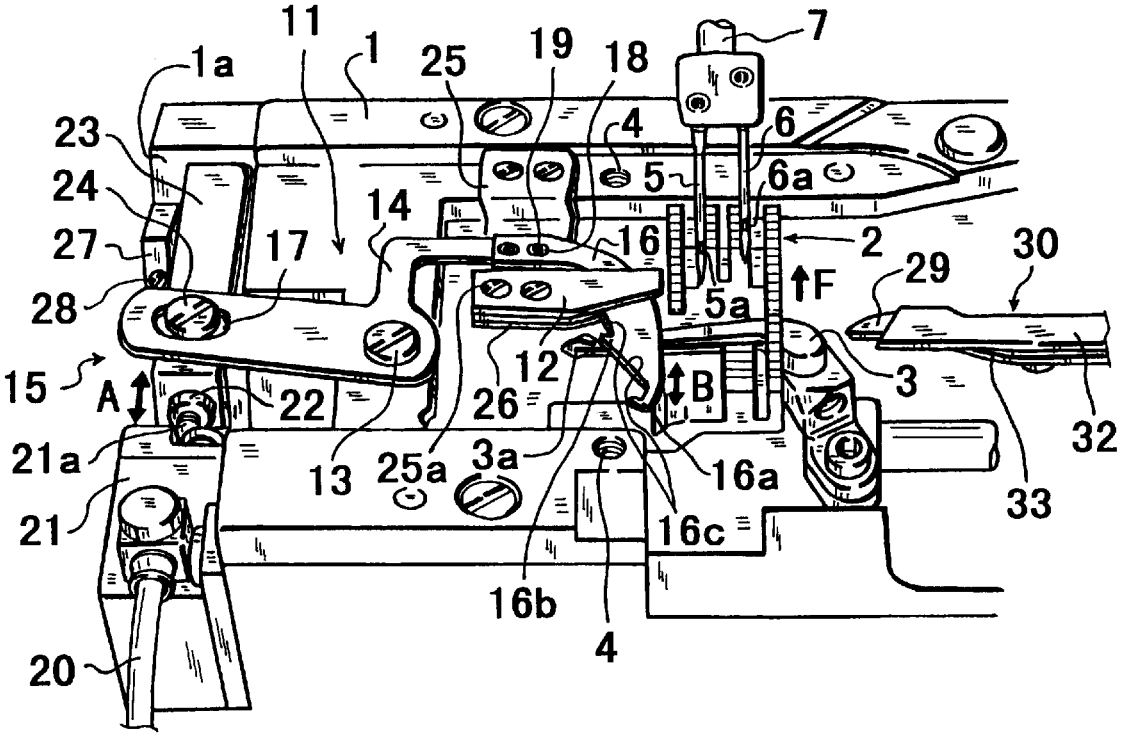
FIG. 1 is a perspective view of an embodiment of an apparatus for preventing a stitching from raveling according to the present invention showing essential parts.

FIG. 1 is a perspective view of essential parts of a sewing machine in which an apparatus for preventing a stitching from raveling of the invention is incorporated. A cylinder bed 1 of this sewing machine has a feed dog 2 for feeding a cloth W in a direction of arrow by moving vertically and longitudinally, a looper 3 for oscillating back and forth in a direction crossing with the cloth feed direction F, and a throat plate (not shown) fixed in a screw hole 4.

Above the cylinder bed 1, a needle bar 7 having a left needle 5 and a right needle 6 is provided. By the vertical motion of this needle bar 7, the tip ends of the needles 5, 6 penetrate into needle holes (not shown) in a throat plate. The looper 3 oscillates almost horizontally on an elliptical orbit between the forward position and backward position across the tip ends of the needles 5, 6 penetrating through the needle holes in the throat plate.

Figure 4:
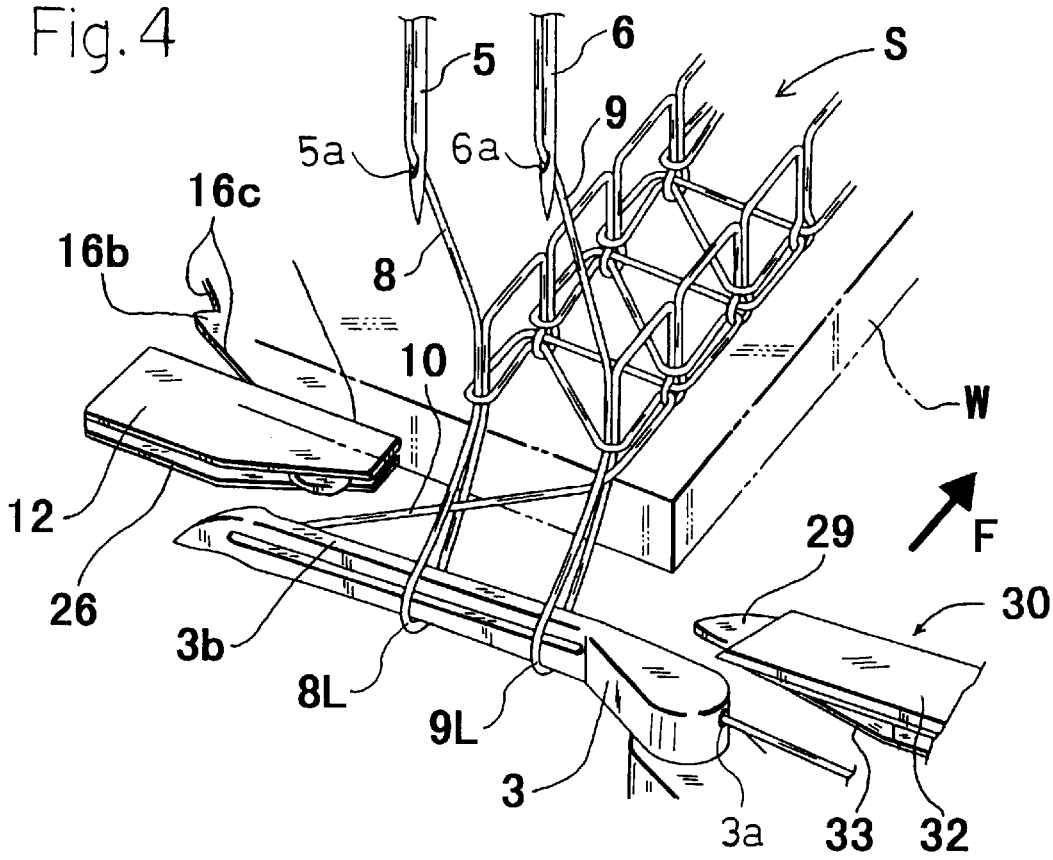
FIG. 4 is a schematic perspective view showing a first step at the finish of showing on a double chain stitch in the embodiment of the apparatus of FIG. 1.
Figure 5:
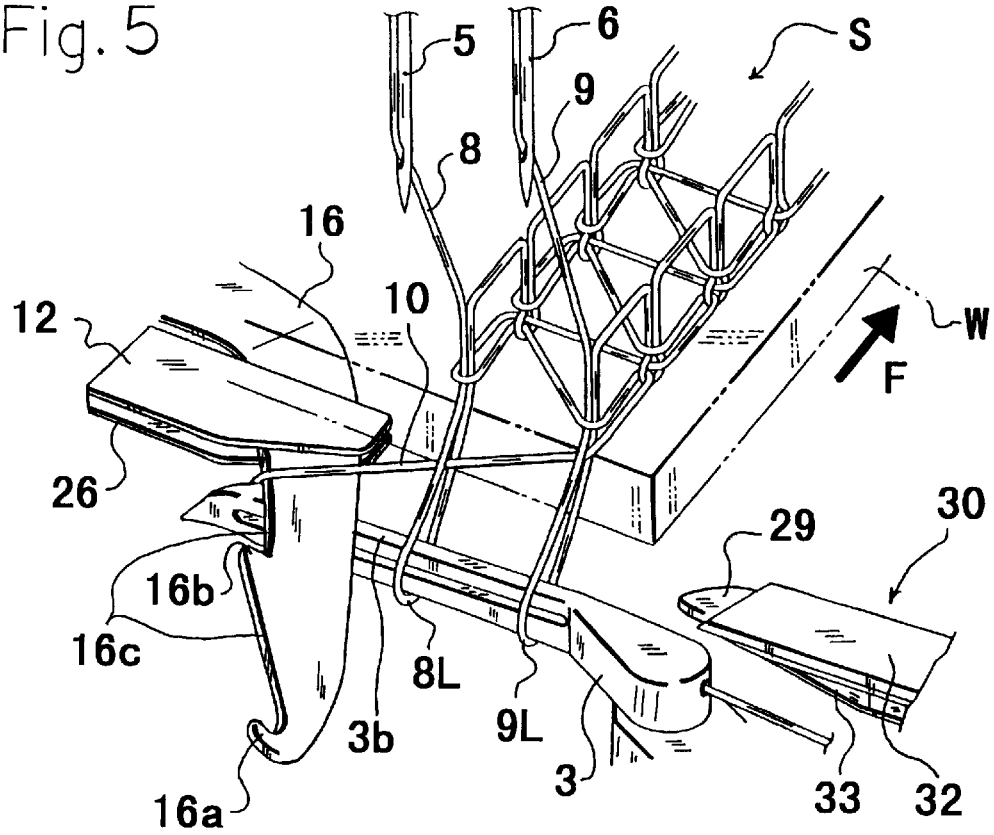
FIG. 5 is a schematic perspective view showing a second step at the finish of sewing on a double chain stitch.
Figure 6:
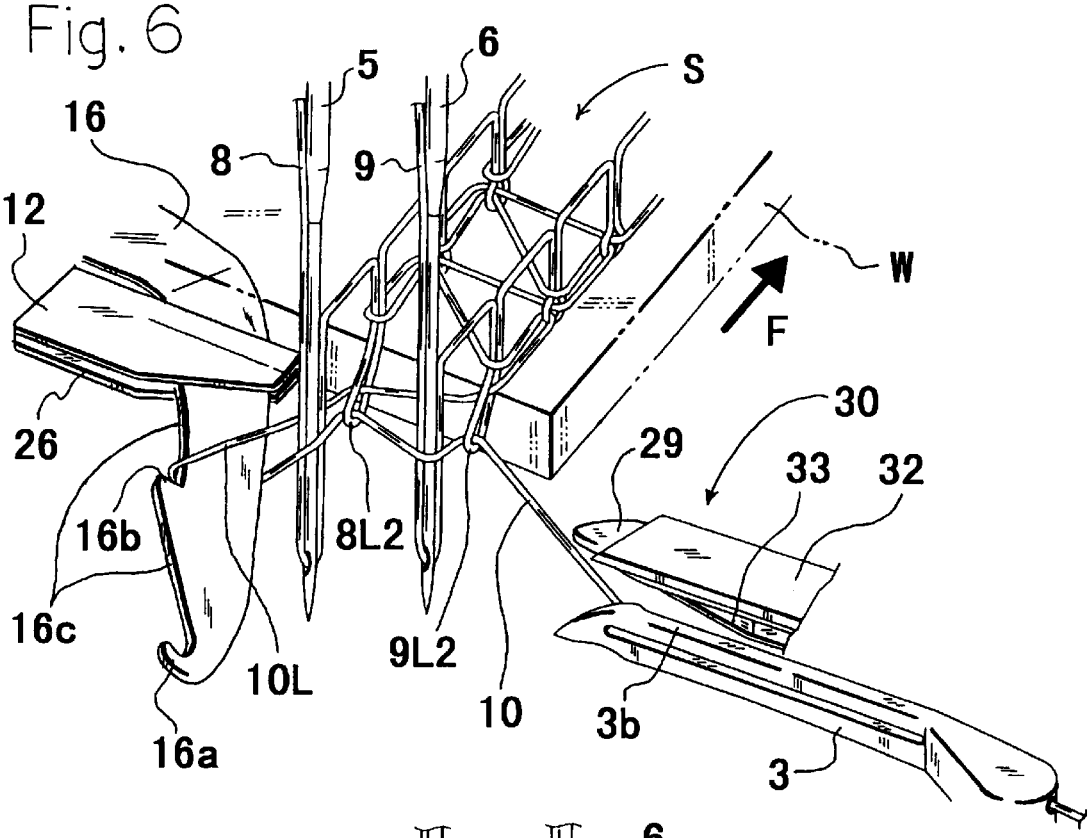
FIG. 6 is a schematic perspective view showing a third step.

As shown in FIG. 4 through FIG. 11, the tip ends of the needles 5, 6 are provided with thread holes 5*a*, 6*a* for inserting needle threads 8, 9, and a blade 3*b* of the looper 3 has an eyelet 3*a* for inserting a looper thread 10. By the collaboration of the needles 5, 6 threaded the needle threads 8, 9 in the thread holes 5*a*, 6*a*, and the looper 3 threaded the looper thread 10 in the eyelet 3*a*, as shown in FIG. 4 and FIG. 5, a thread triangle is formed of loop-shaped needle threads 8L, 9L consecutive to the needles 5, 6 via the blade 3*b* of the looper 3 from the cloth W and the looper thread 10 along the looper 3 via the eyelet 3*a* from the cloth W. Thereafter, as shown in FIG. 6, the needle thread loops 8L2, 9L2 which the looper 3 is detached from the loop-shaped needle threads 8L, 9L are pulled up to the cloth W, so that a double chain stitch S is formed in the cloth W.

At the left side of the feed dog 2 in FIG. 1, that is, at the tip end portion of the cylinder bed 1, there are looper thread engaging means 11 for forming a looper thread loop 10L consecutive from the cloth W at its engaged portion by driving the sewing machine in an engaged state by engaging with the looper thread 10 consecutive to the looper 3 from the cloth W by moving, and a looper thread cutter 12 for cutting off the looper thread loop 10L at said engaged portion.

The looper thread engaging means 11 includes a looper thread engaging member 14 mounted on the cylinder bed 1 rotatably (movably) by means of a stepped screw 13, and a driving member 15 for rotating (moving) the looper thread engaging member 14. The looper thread engaging member 14 has a crook lever 16 at one side, and a slot 17 is formed at other side. The tip end of the crook lever 16 has, as most clearly shown in FIG. 5 through FIG. 7, a taper portion 16*c*, and two crooks 16*a*, 16*b* protruding at the middle position and leading end position of the taper portion 16*c*, respectively. The base end portion of the crook lever 16 is adjustably fixed to a position on the looper thread engaging member 14 through a slot 18 and a screw 19.

Figure 2:
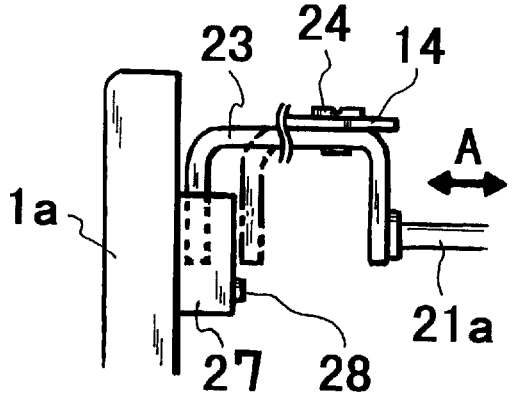
FIG. 2 is a magnified side view of the apparatus of FIG. 1.

The driving member 15 is disposed at the tip end of the cylinder bed 1, and comprises a pneumatic cylinder 21 in which air is supplied from a high pressure air source (not shown) through a tube 20, a pi-shaped working piece 23 (see FIG. 2) fixed adjustably to a position on a piston rod 21*a* of the pneumatic cylinder 21 through a screw 22, and a stepped screw 24 coupled to the looper thread engaging member 14 through the slot 17 on the upper surface of the working piece 23. By the pneumatic force supplied from the high pressure air source, the working piece 23 fixed on the piston rod 21*a* is forced to move back and forth in the direction of arrow A shown in FIG. 1 and FIG. 2. By the forward and backward motion of the working piece 23, the crook lever 16 of the looper thread engaging member 14 is forced to rotate (move) about the stepped screw 13 in the direction of arrow B.

The looper thread cutter 12 is fixed on a bracket 25 fixed on the cylinder bed 1 by means of a screw 25*a*, and is disposed along the lower surface of the throat plate. The looper thread cutter 12 is provided with a push spring 26. This push spring 26 is provided beneath the bracket 25, and pushes the crook lever 16 of the looper thread engaging member 14 to the looper thread cutter 12. The center of the bracket 25 is dented so as not to interfere with the crook lever 16 rotating about the stepped screw 13.

Figure 3:
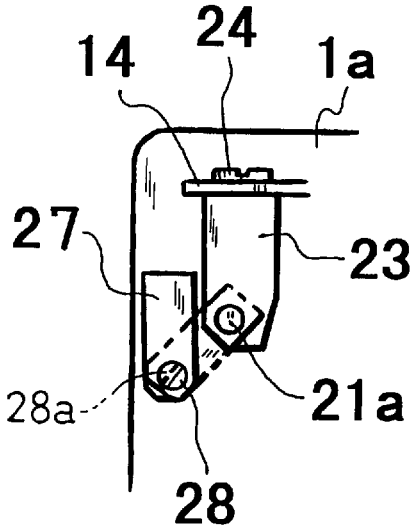
FIG. 3 is a magnified front view of the apparatus of FIG. 1.

At the tip end of the cylinder bed 1, there is defining means 27 for defining the rotating angle (moving distance) of the looper thread engaging member 14. This defining means 27 is a stopper piece composed of a rectangular block fixed angle-adjustably to the tip end wall la of the cylinder bed 1 through a screw 28. This stopper piece 27 of rectangular block has a screwhole 28 a provided at a lower position from the center of gravity of the rectangular shape in this block. By loosening the screw 28, the entire stopper piece 27 can be changed in angle about the screw hole 28*a*. When the stopper piece 27 is positioned in the moving range of the working piece 23 in the driving member 15 as indicated by single dot chain line in FIG. 2 and FIG. 3, the working piece 23 is designed so as to define its moving distance.

At the right side of the feed dog 2 in FIG. 1, that is, at the base end portion of the cylinder bed 1 of the sewing machine, there is a thread cutter 30 for cutting off the needle threads 8, 9 consecutive to the needles 5, 6 via the looper 3 from the cloth W and the looper thread 10 consecutive to the looper 3 from the cloth W between the cloth W and the looper 3 by the forward and backward move of a hook 29. The hook 29 is driven by a well-known driving device (not shown), and moves back and forth between the forward position and backward position along the upper side of the blade 3*b* of the looper 3. The thread cutter 30 has a fixed knife 32 and a push spring 33. The hook 29 is pressed to the fixed knife 32 by the push spring 33, and cuts off the thread in collaboration with the fixed knife 32 at the backward position.

In the apparatus for preventing a stitching from raveling having above-mentioned constitution, the ravel preventing operation at sewing finish is explained by reference to FIG. 4 through FIG. 11.

As shown in FIG. 4, the cloth W is fed in the direction of arrow F by the feed dog 2 of the sewing machine. In the fed cloth W, a double chain stitch S of stitch type 406 is formed by the needle threads 8, 9 and looper thread 10 respectively threaded to the needles 5, 6 and looper 3. As nearing the finish of the stitch forming in the cloth W, as shown in FIG. 4, when the needles 5, 6 are nearly at the upper dead point and the looper 3 is close to the forward position, the pneumatic cylinder 21 is operating by the pneumatic force from the high pressure air source, and the looper thread engaging member 14 is rotated in the clockwise direction about the stepped screw 13.

By rotation of the looper thread engaging member 14, the crook lever 16 moves above the blade 3*b* of the looper 3 so as to cross it along the nearly opposite direction of the cloth feed direction F. By this crossing motion, as shown in FIG. 5, the tip end of the crook lever 16 is inserted into the thread triangle, and the taper portion 16*c* formed at the base end side of the crook lever 16 from the crook 16*b* at the middle position is engaged with the looper thread 10 consecutive to the looper 3 from the cloth W.

Figure 9:
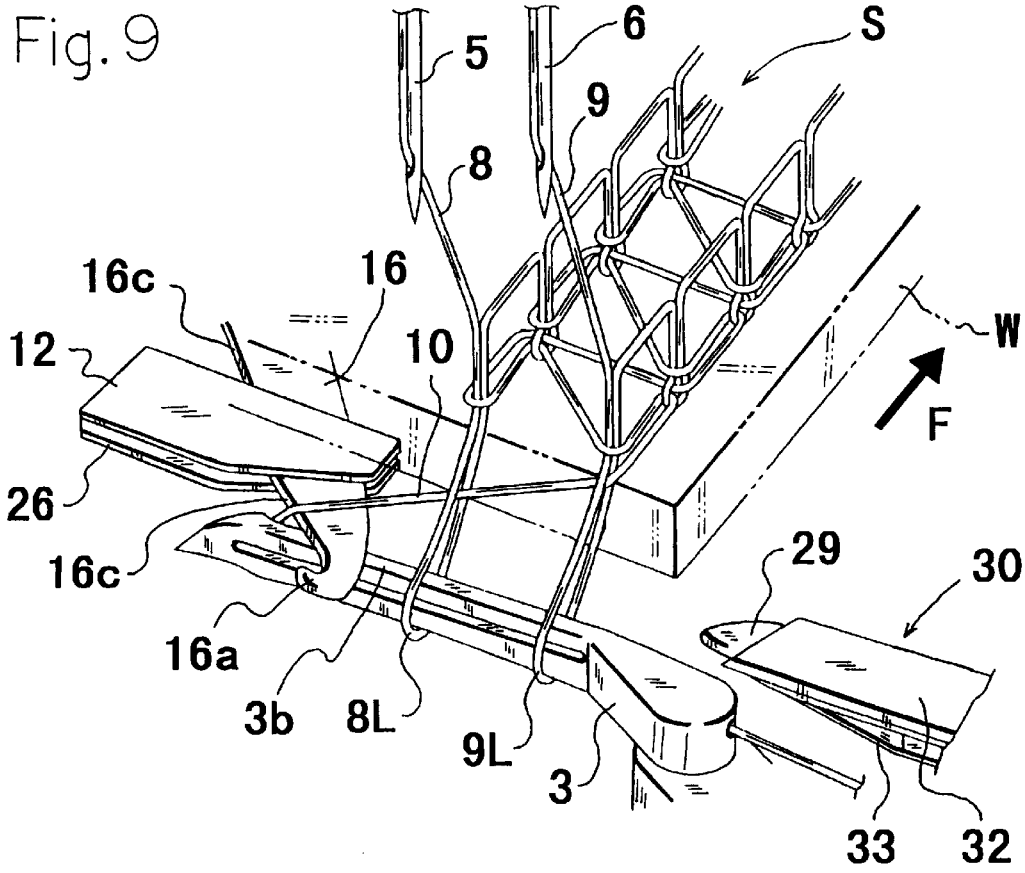
FIG. 9 is a schematic perspective view showing a first step at sewing finish on a double chain stitch when the moving distance is defined.

Herein, if the stopper piece 27 is positioned in the moving range of the working piece 23 in the driving member 15, the moving distance of the working piece 23 is defined. Therefore, as shown in FIG. 9, the degree of engagement of the crook lever 16 with the looper thread 10 is changed and becomes shallow. That is, the taper portion 16*c* formed between the crook 16*a* and the crook 16*b* is engaged with the looper thread 10 consecutive to the looper 3 from the cloth W.

In succession, as shown in FIG. 6, the needles 5, 6 descend into the thread triangle, and the looper 3 moves back to the backward position through the front side of the needles 5, 6. At this time, by the needle thread loops 8L2, 9L2 detached from the looper 3, the looper thread engaged with the taper portion 16*c* (engaged portion) of the crook lever 16 is pulled up to the cloth W, so that the looper thread loop 10L consecutive to the cloth W is formed.

Figure 10:
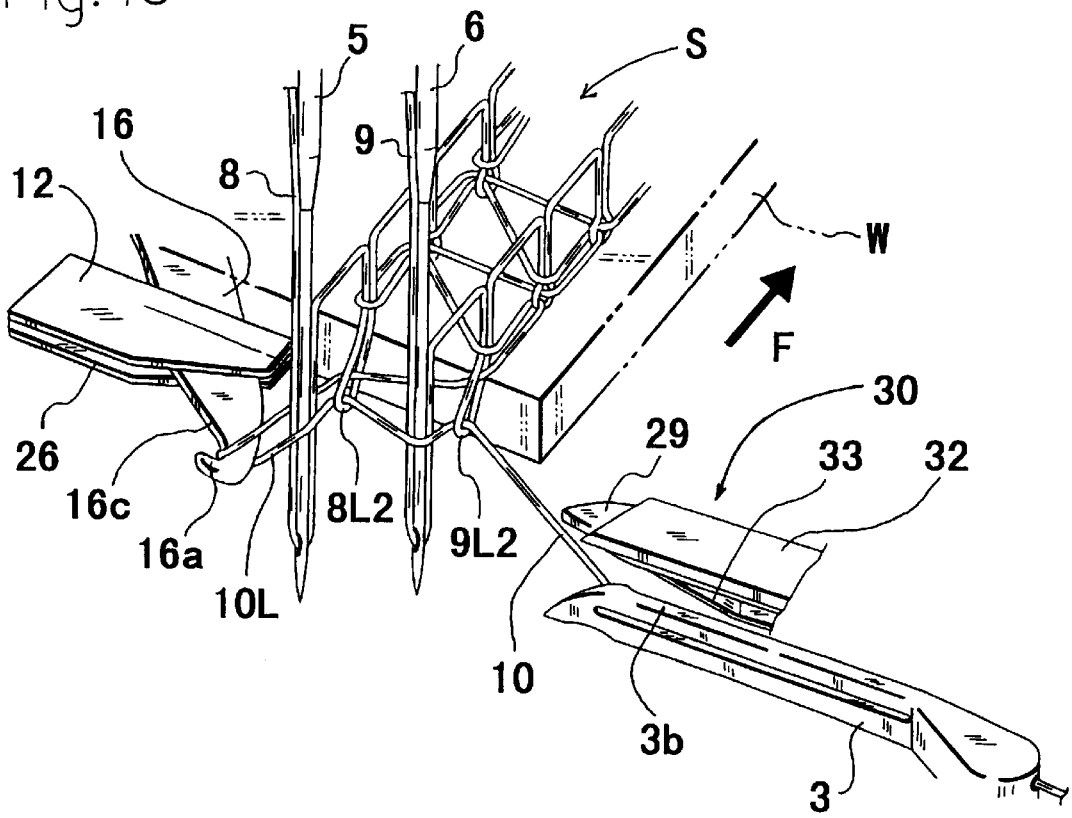
FIG. 10 is a schematic perspective view showing a second step at sewing finish on a double chain stitch when the moving distance is defined.

When the stopper piece 27 is positioned outside of the moving range of the working piece 23 in the driving member 15, the looper thread loop 10L engaged with the taper portion 16*c* is in a state as shown in FIG. 6, and when the stopper piece 27 is positioned in said moving range, the looper thread loop 10L engaged with the taper portion 16*c* is in a state as shown in FIG. 10. That is, when the moving distance of the looper thread engaging member 14 is defined by the stopper piece 27, as compared with the case not defined, the looper thread loop 10L held by the taper portion 16*c* is shorter.

Figure 7:
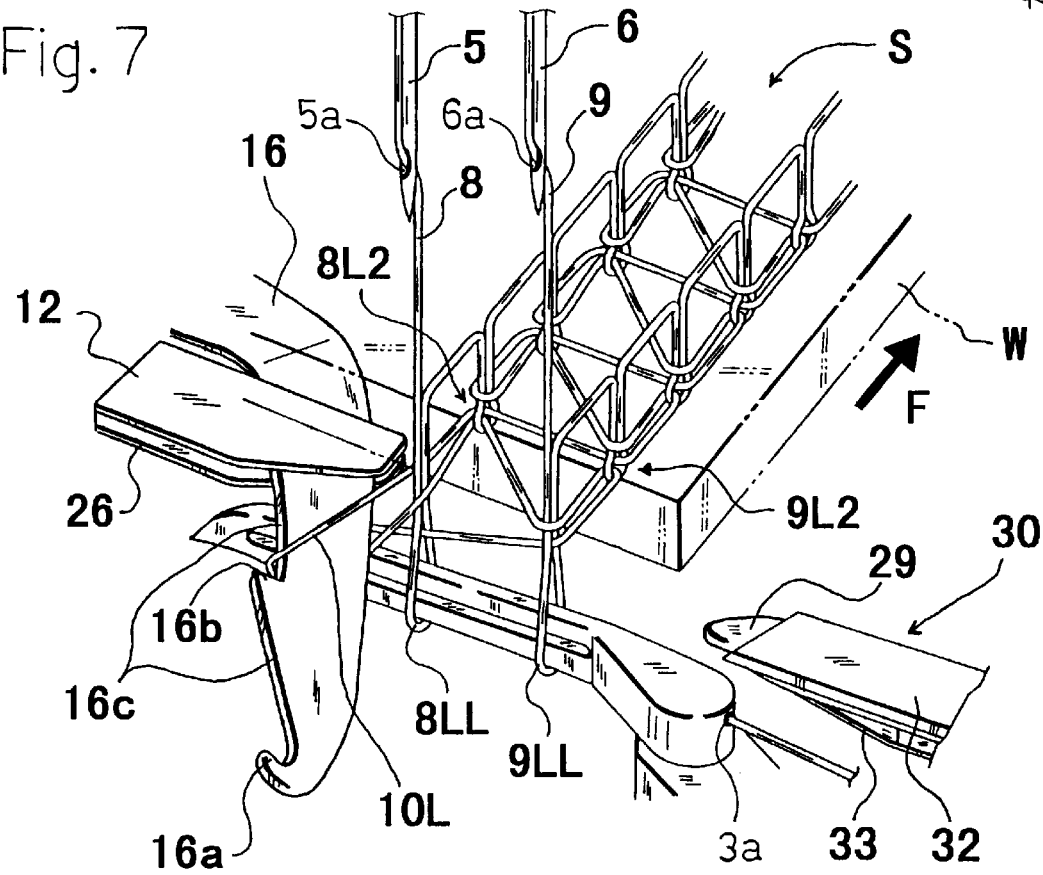
FIG. 7 is a schematic perspective view showing a fourth step at sewing finish on a double chain stitch.
Figure 11:
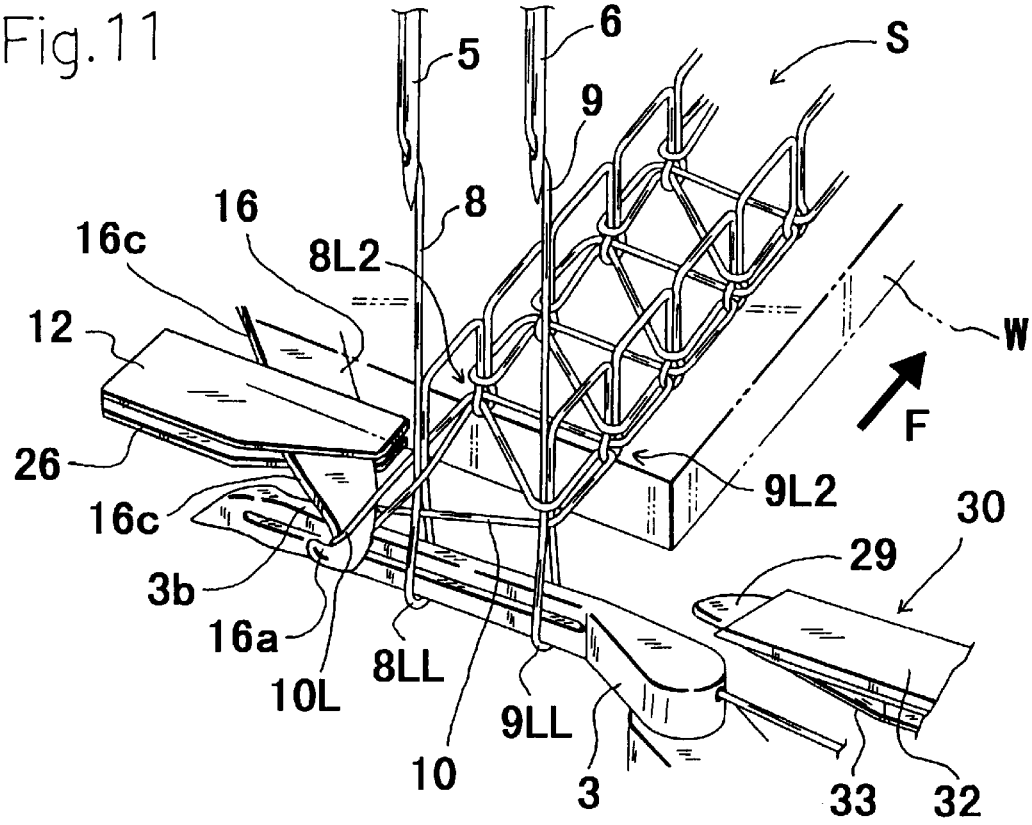
FIG. 11 is a schematic perspective view showing a third step at sewing finish on a double chain stitch when the moving distance is defined.

While the looper 3 moving forward through the backward position passes the back side of the needles 5, 6, said looper 3 captures a needle thread loop newly formed by the needles 5, 6 ascending from the lower dead point, and new loop-shaped needle threads 8LL, 9LL are formed. That is, FIG. 7 shows a state of driving the sewing machine for one stitch from the state in FIG. 5, and FIG. 11 shows a state of driving the sewing machine by one stitch from the state in FIG. 9. In either case, the looper thread loop 10L engaged with the taper portion 16*c* of the crook lever 16 keeps its state slightly above the looper 3.

At this time, by suspension of pneumatic pressure from the high pressure air source, the pneumatic cylinder 21 is operated, and the looper thread engaging member 14 is rotated in the counterclockwise direction about the stepped screw 13. By the rotation of the looper thread engaging member 14, the looper thread loop 10L engaged with the taper portion 16*c* is transferred to engagement of the crook 16*b*, (in the case from the state shown in FIG. 11, the looper thread loop 10L is transferred to engagement of crook 16*a*,) and then the looper thread loop 10L at the engaged portion is cut off beneath the looper thread cutter 12. In this way, the both thread ends 10*f*, 10*e* cut off by the looper thread cutter 12 hang from the cloth W side, and the length of the thread ends 10*f*, 10*e* is varied depending on the length of the looper thread loop 10L engaged with the taper portion 16*c*.

Figure 8:
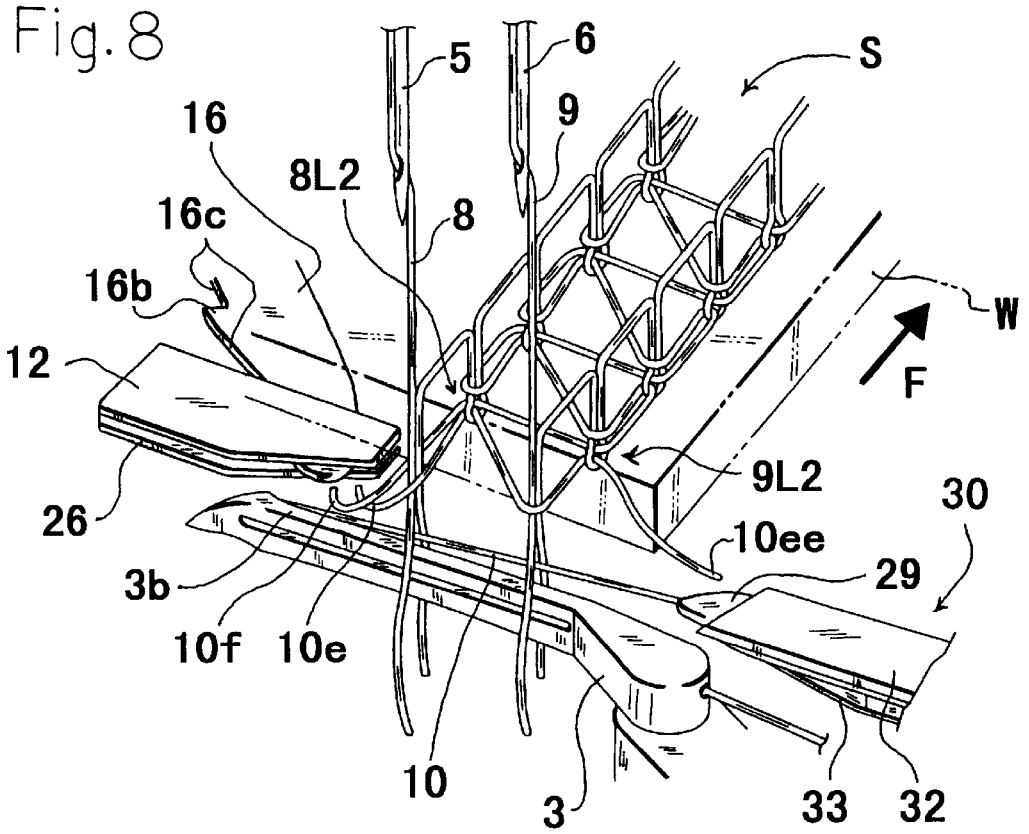
FIG. 8 is a schematic perspective view showing a fifth step at sewing finish on a double chain stitch.

At cutting off the looper thread loop 10L, by driving the driving device not shown, the hook 29 moves back and forth between the forward position and backward position along the upper side of the blade 3*b* of the looper 3. The hook 29 moving backward from the forward position to the backward position is engaged with the looper thread 10 consecutive to the looper 3 from the cloth W, and new loop-shaped needle threads 8LL, 9LL consecutive to the needles via the looper 3 from the cloth W. By collaboration with the fixed knife 32, the looper thread 10 and the new loop-shaped threads 8LL, 9LL engaged with the hook 29 are cut off between the cloth W and the looper 3 as shown in FIG. 8.

The cut-off thread end 10*f* is not raveled at the sewn end of the cloth W unless it is pulled out from the needle thread loop 8L2 at the end of sewing.

In this embodiment, cutting-off of the threads 8LL, 9LL, 10 by the hook 29 and thread cutter 30 is done prior to cut-off of the looper thread loop 10L by the looper thread engaging means 11 and looper thread cutter 12, but the looper thread loop 10L may be cut off simultaneously or before cutting-off of the threads 8LL, 9LL, 10L.

In particular, cutting-off of the looper thread loop 10L by the looper thread engaging means 11 and looper thread cutter 12 may be done in a state of lifting the looper thread loop 10L engaged with the looper thread engaging means 11 to the cloth by the needle thread loops 8L2, 9L2, for example, in a state shown in FIG. 6 or FIG. 10. Incidentally, driving of the sewing machine by one stitch or controlling of the start of each cutting device are not specifically described herein, but it may be executed easily by using the rotation control device of a well-known sewing machine motor or controlling means by a rotation signal of a detector provided in the main shaft of the sewing machine.

Figure 12:
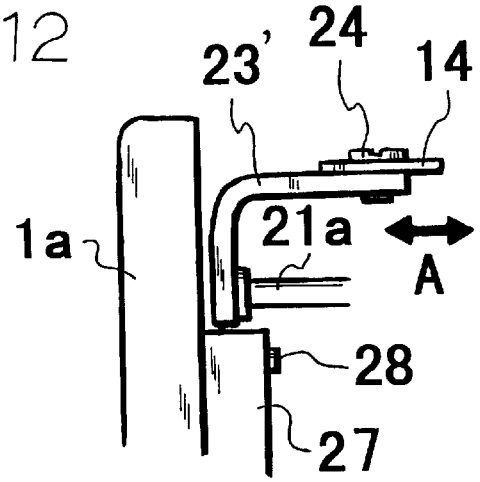
FIG. 12 is an essential magnified side view showing other embodiment of an apparatus for preventing a stitching from raveling.

In the embodiment, the pi-shaped working piece 23 is used, but not limited to this, for example, an L-shaped working piece 23' may be formed, and it may be fixed at an adjustable position on the piston rod 21*a* of the pneumatic cylinder 21 as shown in FIG. 12. In particular, the L-shaped working piece 23' is effective in the sewing machine having narrow bed.

Also in the embodiment, the stopper piece 27 is positioned nearly at the side of the working piece 23, but not limited to this, for example, it may be disposed either above or beneath the working piece 23'.

Figure 13:
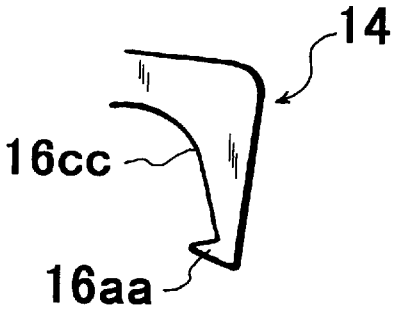
FIG. 13 is an essential magnified schematic plan view showing the other embodiment of an apparatus for preventing a stitching from raveling.
Figure 14:
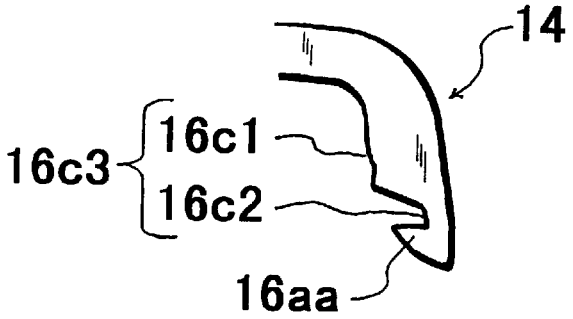
FIG. 14 is an essential magnified schematic plan view showing another embodiment of an apparatus for preventing a stitching from raveling.

Further in the embodiment, the crook lever 16 at the tip end of the looper thread engaging member 14 has a taper portion 16*c* and two crooks 16*a*, 16*b* protruding at the nearly middle position and at the tip end position of the taper portion 16*c*, but it is not limited to this constitution. For example, as shown in FIG. 13, the tip end side of the looper thread engaging member 14 may be composed of a taper portion 16*cc* and one crook 16*aa* consecutive to the tip end side of the taper portion 16*cc*. Or, as shown in FIG. 14, the tip end side of the looper thread engaging member 14 may be composed of a thread engaging portion 16*c*3 forming a broad portion 16*c*1 and a narrow portion 16*c*2 in steps, and a crook 16*aa* consecutive to the narrow potion 16*c*2, and the looper thread engagement with the broad portion or narrow portion may be varied depending on the definition of the moving distance of the driving member by the stopper piece.

What is claimed is:

1. An apparatus for preventing stitching from raveling, said apparatus comprising:

a sewing machine having at least one needle moving vertically, and a looper for forming a double chain stitch formed of needle thread and looper thread in a cloth by collaboration with the needle while the looper oscillates almost horizontally between a forward position and backward position across the needle, looper thread engaging means for engaging with the looper thread consecutive to the looper from the cloth by moving when the looper is at the forward position and for forming a looper thread loop consecutive from the cloth at the engaged portion by driving the sewing machine in said engaged state, a looper thread cutter for cutting the looper thread loop formed at the engaged portion, a thread cutter for cutting the loop-shaped needle thread consecutive to the needle via the looper from the cloth and the looper thread consecutive to the looper from the cloth between the cloth and the looper, and defining means defining the moving distance of said looper thread engaging means, wherein the length of the looper thread loop is changed by definition of the moving distance of the looper thread engaging means by said defining means, and therefore the length of the thread end left over in the cloth by said looper thread cutter is varied.

2. The apparatus for preventing stitching from raveling as claimed in claim 1, wherein said looper thread engaging means includes at least a looper thread engaging member and a driving member for moving said looper thread engaging member to an engagement position for the looper thread, and said defining means consists of a stopper piece for defining the moving distance of said driving member.

3. The apparatus for preventing stitching from raveling as claimed in claim 2, wherein said looper thread engaging member has a taper and two crooks protruding nearly at the middle position and tip end position of said taper, and the looper thread engagement with said taper across the crook of said middle position can be changed depending on the definition of the moving distance of the driving member by the stopper piece.

4. The apparatus for preventing stitching from raveling as claimed in claim 2, wherein said looper thread engaging member has a taper and a crook consecutive to the narrow end side of said taper.

5. The apparatus for preventing stitching from raveling as claimed in claim 2, wherein said looper thread engaging member has a thread engaging portion having a wide portion and a narrow portion formed in a step, and a crook consecutive to the narrow portion of said thread engaging portion, and wherein the looper thread engagement with the wide portion or narrow portion is varied depending on the definition of the moving distance of the driving member by said stopper piece.

6. The apparatus for preventing stitching from raveling as claimed in claim 2, wherein said stopper piece is composed of a rectangular block fixed in the sewing machine at an adjustable angle, and the moving distance of the driving member is defined by varying the fixing angle of the rectangular block on the sewing machine.

7. The apparatus for preventing stitching from raveling as claimed in claim 3, wherein said stopper piece is composed of a rectangular block fixed in the sewing machine at an adjustable angle, and the moving distance of the driving member is defined by varying the fixing angle of the rectangular block on the sewing machine.

8. The apparatus for preventing stitching from raveling as claimed in claim 4, wherein said stopper piece is composed of a rectangular block fixed in the sewing machine at an adjustable angle, and the moving distance of the driving member is defined by varying the fixing angle of the rectangular block on the sewing machine.

9. The apparatus for preventing stitching from raveling as claimed in claim 5, wherein said stopper piece is composed of a rectangular block fixed in the sewing machine at an adjustable angle, and the moving distance of the driving member is defined by varying the fixing angle of the rectangular block on the sewing machine.

* * * * *